United States Patent [19]

Sakai et al.

[11] 4,248,809

[45] Feb. 3, 1981

[54] METHOD AND APPARATUS FOR DETECTING DAMAGE OF BLAST FURNACE INSIDE WALL REPAIRING MATERIALS

[75] Inventors: Toshihiko Sakai; Sumio Kobayashi; Takao Suzuki, all of Amagasaki, Japan

[73] Assignee: Sumitomo Metal Industries Limited, Osaka, Japan

[21] Appl. No.: 15,744

[22] Filed: Feb. 27, 1979

[30] Foreign Application Priority Data

Feb. 28, 1978 [JP] Japan ..... 53-23149

[51] Int. Cl.[3] ..... F27D 1/16

[52] U.S. Cl. ..... 264/30; 73/86; 264/40.1

[58] Field of Search ..... 264/30, 40.1; 73/86

[56] References Cited

U.S. PATENT DOCUMENTS

| | | | |
|---|---|---|---|
| 3,015,950 | 1/1962 | Doctor | 73/86 |
| 3,202,732 | 8/1965 | Braun | 264/30 |
| 3,307,401 | 3/1967 | Bachman | 73/86 X |
| 3,532,797 | 10/1970 | Lunig | 73/86 |

*Primary Examiner*—Thomas P. Pavelko

*Attorney, Agent, or Firm*—Watson, Cole, Grindle & Watson

[57] ABSTRACT

In repairing a blast furnace wall by injecting and solidifying a refractory material on the inside wall of the furnace from outside the furnace, a line consisting of metallic coaxial lines or metallic parallel lines insulated from each other is embedded in the refractory material and the variation of the length of this line is measured through an electric signal to detect the remaining thickness of the injected and solidified refractory material in the furnace wall part.

By such detection, the damage of the repaired part of the blast furnace can be known with the lapse of time.

4 Claims, 7 Drawing Figures

METHOD AND APPARATUS FOR DETECTING DAMAGE OF BLAST FURNACE INSIDE WALL REPAIRING MATERIALS

BACKGROUND OF THE INVENTION

1. Field of the Invention

This invention relates to method and apparatus for detecting damage of refractory materials injected and used within a blast furnace to repair the furnace body from outside.

2. Description of the Prior Art

The technique of repairing a damaged part of a blast furnace wall by injecting a fluid refractory material from outside the furnace is already known from publications by the present inventors such as, for example, Japanese Laid Open Patent 123501/50, Published on Sept. 29, 1975, and U.S. Pat. No. 4,102,694.

The above mentioned repairing methods repair only the local damaged part of the blast furnace wall from outside the furnace, and are therefore different from relining the entire furnace, and can be applied to the blast furnace even during the operation thereof, and contribute greatly to extending the life of the furnace.

However, the part repaired by injecting and solidifying the fluid refractory material naturally has different characteristics than the furnace wall lined with firebricks. In some cases, the repaired part will be again damaged earlier than the other parts.

However, a technique of determining the damage of the refractory material during the use of the furnace with metallic coaxial lines or metallic parallel lines (ED-sensor) embedded in the refractory material in building the blast furnace or another furnace is also known from the Japanese Laid Open Patent No. 133207/49, Published on Dec. 20, 1974 by one of the present inventors.

SUMMARY OF THE INVENTION

An object of the present invention is to provide method and apparatus wherein, in the technique of repairing a damaged part of a blast furnace refractory wall by injecting a fluid refractory material from outside the furnace, the damage during the blast furnace operation of the part repaired with the injected refractory material is measured with the lapse of time so that the time to require the re-repair may be accurately judged.

The repaired part is the severest damaged part within the furnace, has different characteristics than the other parts, and is therefore only likely to be quickly damaged depending on the blast furnace operating conditions.

Therefore, it is very important to both operation and repair of the blast furnace to know the damage of the repaired part with the lapse of time.

In this sense, the present invention is very different from the technique of embedding ED sensors in advance in the refractory of the furnace wall or the like in building the furnace. Further, it is in fact so difficult to embed many ED sensors in advance in a part in which a large damage is anticipated that it is effective also to the judgment of the operating state of the furnace to embed a sensor in the repaired part, that is, the part most likely to be damaged.

DETAILED DESCRIPTION OF PREFERRED EMBODIMENTS

A repairing refractory material (which shall be called a refractory material hereinafter) 1 is injected to be solidified and deposited on the inside wall surface of a damaged part within a furnace from outside the furnace through injecting port 3 and injecting pipe 4 provided on mantle 2.

Figure 5:
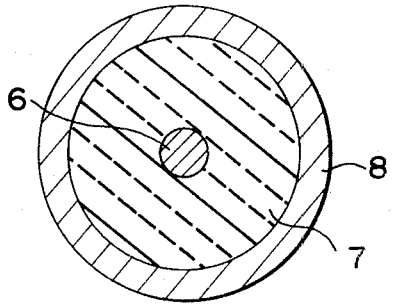
FIG. 5 is a cross-sectional view of metallic coaxial lines used in the present invention.
Figure 6:
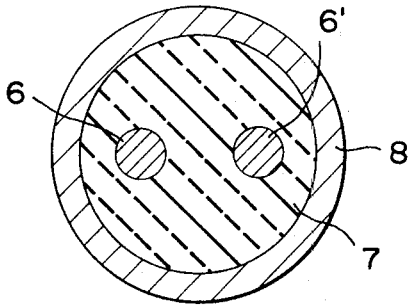
FIG. 6 is a cross-sectional view of matallic parallel lines also used in the present invention.

Reference numeral 5 indicates a metallic coaxial line which consists of a inner conductor 6, refractory insulator 7, and a outer conductor 8 as illustrated in FIG. 5, or a metallic parallel line which consists of parallel metallic lines 6 and 6', refractory insulator 7, and a protective pipe 8 as illustrated in FIG. 6.

Line 5 is to be embedded after the completion of the injection of slurry refractory material 1. If it is embedded immediately after the completion of the injection, the refractory material 1 will be so soft as to be likely to leak out of the furnace through the injecting port. Therefore, at a fixed time after the completion of the injection, just before refractory material 1 begins to solidify, line 5 is inserted and embedded through injecting port 3. If too much time elapses after completion of the injection, the solidification of refractory material 1 will progress so far that it will be difficult to embed line 5. The time to embed line 5 (the time after the injection) is different depending on the repairing refractory material to be used. However, in the embodiment described herein, there is adopted a manner in which line 5 is inserted and embedded after 20 to 30 minutes after completion of the injection. In order to prevent the gas from leaking out of the furnace, injecting pipe 4 is charged with sealing material 9 and has closing plate 10 fixed to the opening to complete the embedding of line 5.

In such case, the inserting depth $l_0$ of line 5 to be embedded will be determined by the amount of the refractory material injected through injecting port 3 and will be obtained as a sum of the thickness $l_1$ of the protective furnace wall expected to be formed, thickness $l_2$ of the remaining furnace wall firebrick, thickness $l_3$ of the mantle and length $l_4$ of the injecting pipe. The thickness $l_2$ of the unknown remaining furnace wall firebrick must be determined before the refractory material 1 is injected. Thickness $l_2$ of the furnace wall firebrick can be determined by passing a length of measuring rod bent to be L-shaped at the tip through the injecting port 3 after it is bored.

Figure 1:
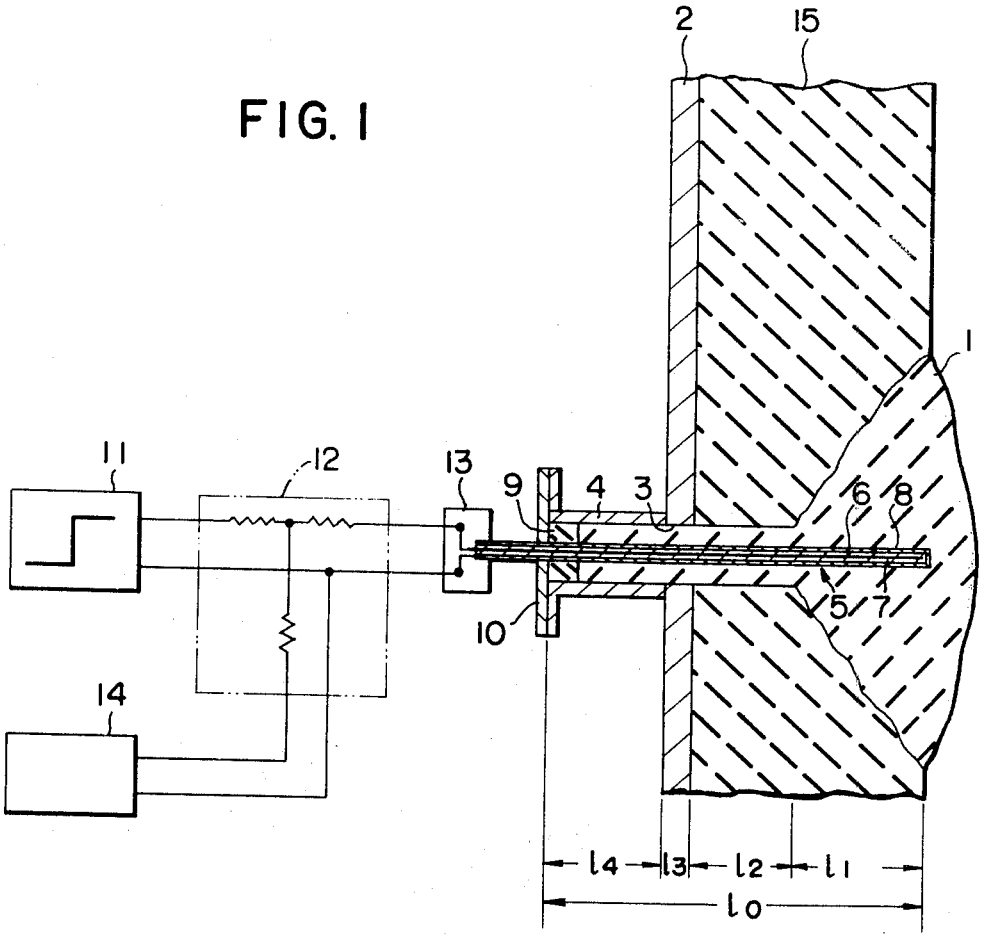
FIG. 1 is a schematic view showing an embedded line and a measuring circuit of the present invention.

In the embodiment illustrated in FIG. 1, it is shown that refractory material 1 forms a protective furnace wall of a thickness larger than the thickness $l_1$ of the protective furnace wall expected from the result of injecting the refractory material 1, or from a fundamental experiment by using a model.

For the repairing refractory material, it is preferable to use a material (Japanese Patent Publication 123501/50 and U.S. Pat. No. 4,102,694) already suggested by one of the present inventors. This material consists of 100 parts by weight of a powdery refractory material, 4 to 40 parts by weight of a bituminous material and 10 to 35 parts by weight of a liquefied oil, and is different from an already generally used refractory slurry containing water. Even if it is injected at a mantle temperature above 200° C., it will form a repaired wall with very high adhesion to the mantle.

Anticorrosive stainless steels, nichrome, manganine, Ni-base alloys and Fe-Ni-Cr alloys having low resistance variation are proper for the materials to be used for the inner conductor, the outer conductor, the metallic lines and the protective pipe forming the line of the present invention. In order to facilitate the observation of the reflected waveform as an electric signal, it is desirable to make the characteristic impedance of the line 20 to 300Ω. Further, the refractory insulator may be magnesia, alumina, silica or a mixture of such elements having high insulation characteristics at a high temperature.

Step pulse generator 11 which can impress step pulses of a fast rising time such as, for example, 100 picoseconds, is connected to connecting terminal 13 of line 5 through power divider 12 which divides and impresses the signal from the above mentioned step pulse generator 11 on the line and to divide and feed it to waveform monitor 14, which may be an oscilloscope for observing the time variation of the voltage waveform at connecting terminal 13.

Figure 2A:
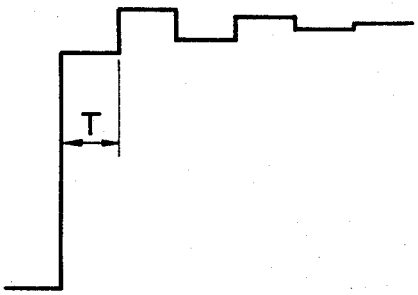
FIGS. 2A and 2B are explanatory graphs of a step pulse waveform observed in the measuring apparatus of the present invention.
Figure 2B:
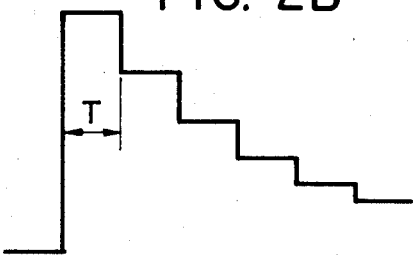
Figure 3:
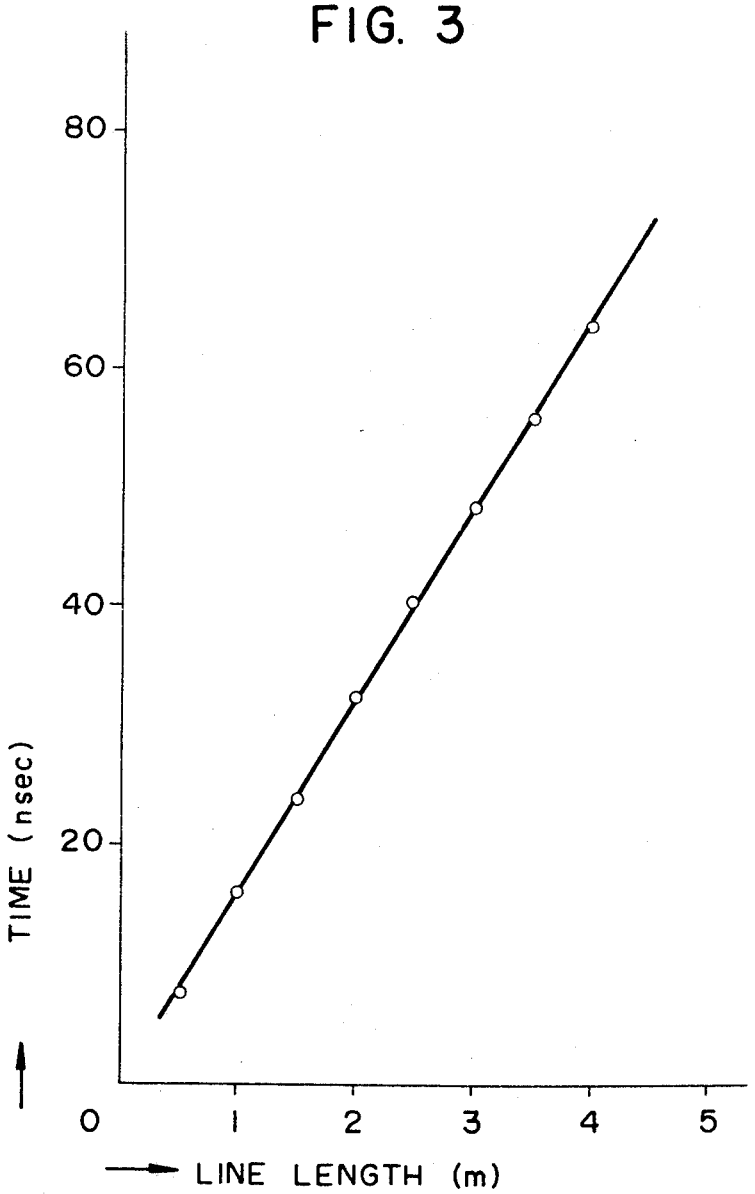
FIG. 3 is a diagram showing the relation between the horizontal remaining time T of the step pulse waveform of FIGS. 2A and 2B and the line length.

In the case of observing with this device, the reflected waveform obtained from the line opened at the tip will repeat a rise and fall with a fixed horizontal remaining time T as shown in FIG. 2A and will gradually converge to the height of the impressed voltage. In case the line is short-circuited at the tip, the reflected waveform will repeat a fall having a fixed horizontal remaining time T and will gradually converge to zero as shown in FIG. 2B. As the horizontal remaining time T of such waveform is directly proportional to the length of the line, the length of the line can be detected by measuring time T.

Therefore, it is considered that, when the protective furnace wall formed by the injection and solidification of refractory material 1 is eroded during the blast furnace operation and the erosion progresses farther than the tip position of line 5, line 5 as well as the above mentioned protective furnace wall will be eroded. Thus, the erosion of the injected solidified refractory material and the thickness of the remaining furnace wall can be judged directly by detecting the length of the line.

Figure 4:
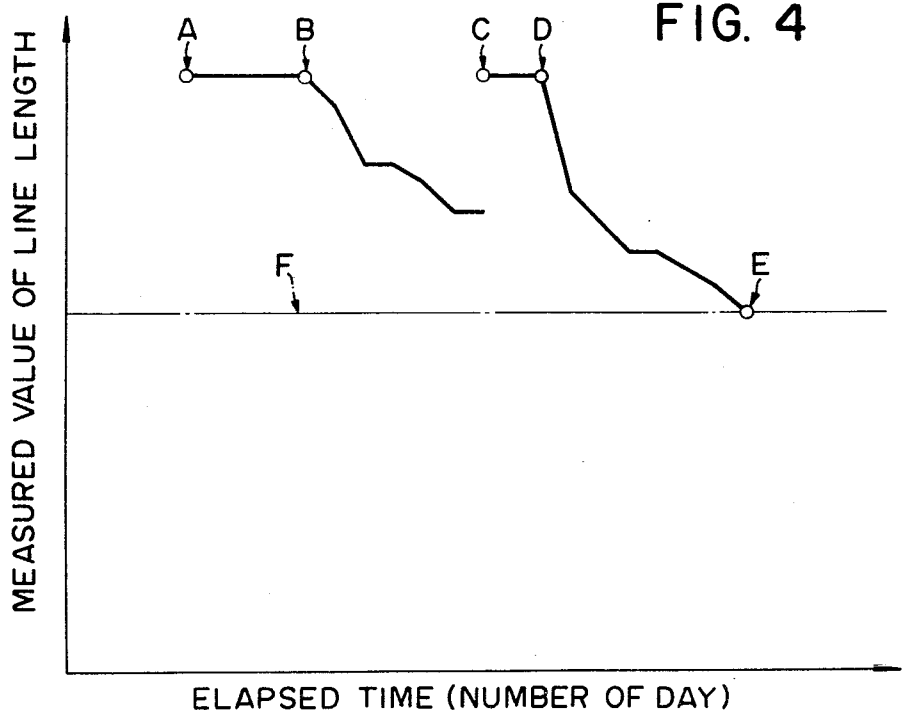
FIG. 4 is a diagram showing the relation between the measured value of the line length and the elapsed time of an embodiment of the present invention.

EXAMPLE:

The values obtained by measuring the lapse of time and the erosion of an injected solidified refractory material composed of 100 parts by weight of an aluminious refractory powder, 25 parts by weight of a pitch and 24 parts by weight of a heavy oil by using a metallic coaxial line which consists of the inner conductor having a diameter of 1 mm and the outer conductor having an outside diameter of 6 mm and thickness of about 1 mm are shown in FIG. 4. First of all, the line embedded at point A began at point B to decrease its length. The erosion of the protective furnace wall progressed to the tip position of the line embedded at point B. Then, at point C, the same amount of the refractory material as in the previous test was injected again and a new line of the same dimensions as are mentioned above was embedded. Then, at point D, the length of the second line began to decrease. At point E, the protective furnace wall made of the repairing refractory material ceased to be damaged. In the diagram, symbol F indicates the inside surface position of the furnace wall firebrick found as a result of the measurement of the depth of the injecting port.

In the present invention, as described above, the remaining thickness of the protective furnace wall can be electrically accurately detected by utilizing the reflection of an electric signal. Therefore, the average life of the erosion of the protective furnace wall can be determined, the amount of any quick damage of the protective furnace wall can be immediately detected, and the reliability of the detection is high. Thus, the present invention is very advantageous to the control of blast furnaces.

What is claimed is:

1. A method of detecting damage of inside wall blast furnace repairing materials, comprising the steps of: injecting a solidifying refractory material into the furnace wall from the exterior thereof, embedding electrically conductive lines insulated from each other into the partially solidified refractory material, impressing step pulses on said embedded lines, measuring the propagation time between the steps in the reflected waveform of said step pulses; and determining the remaining thickness of said refractory material from the measured propagation times.

2. The method according to claim 1 wherein said line is inserted and embedded through an injecting port on the mantle of the blast furnace just before said refractory material begins to solidify.

3. The method according to claim 1 wherein the embedded depth of said line is the sum of the thickness of the remaining furnace wall expected to be formed, the thickness of the remaining furnace wall firebrick, the thickness of the mantle and the length of the injecting pipe.

4. The method according to claim 1 wherein the characteristic impedance of said line is 20 to 300Ω.

* * * * *